United States Patent [19]

Silvestri, Jr.

[11] 3,972,196

[45] Aug. 3, 1976

[54] STEAM PRESSURE INCREASING DEVICE FOR DRIVE TURBINES

[75] Inventor: George J. Silvestri, Jr., Morton, Pa.

[73] Assignee: Westinghouse Electric Corporation, Pittsburgh, Pa.

[22] Filed: May 10, 1974

[21] Appl. No.: 468,710

[52] U.S. Cl. ..... 60/677; 60/715; 60/670

[51] Int. Cl.[2] ..... F01K 17/00; F01K 19/00

[58] Field of Search ..... 60/652, 662, 663, 677, 60/678, 679, 715, 676, 648, 670

[56] References Cited

UNITED STATES PATENTS

| | | | |
|---|---|---|---|
| 1,774,974 | 9/1930 | Hilgers et al. | 60/663 X |
| 2,151,949 | 3/1939 | Turner | 60/649 |
| 2,346,179 | 4/1944 | Meyer et al. | 60/676 |
| 3,083,536 | 4/1963 | Vogler | 60/677 |
| 3,195,304 | 7/1965 | Stern et al. | 60/649 |
| 3,306,044 | 2/1967 | Michel et al. | 60/677 X |
| 3,584,457 | 6/1971 | Davoud | 60/671 X |
| 3,826,093 | 7/1974 | Miliaras | 60/662 X |

*Primary Examiner*—Allen M. Ostrager
*Attorney, Agent, or Firm*—G. H. Telfer

[57] ABSTRACT

A drive turbine having a steam pressure-increasing device connected thereto. Steam taken from a high pressure steam source is utilized as the driving fluid for the pressure-increasing device disposed between the drive turbine inlet and a lower pressure drive turbine steam supply source. The pressure-increasing device increases the pressure level from the steam supply to the drive turbine to maintain a predetermined level of pressure in the supply steam flow.

10 Claims, 3 Drawing Figures

STEAM PRESSURE INCREASING DEVICE FOR DRIVE TURBINES

BACKGROUND OF THE INVENTION

1. Field of the Invention:

This invention relates to steam turbine power plants, and in particular, to a steam turbine power plant having a pressure-increasing device inserted between a steam supply source and a drive turbine element of the power plant. 2. Description of the Prior Art:

In general, steam power plants comprise a high pressure, high temperature steam generator element supplying motive fluid to a closed loop arrangement of one or more steam turbines and associated apparatus. One of the most elemental closed loop arrangements is that comprising a high pressure turbine, an intermediate pressure turbine, and a low pressure turbine having a condenser attached thereto, connected in series with the steam generator. The high pressure, high temperature steam produced by the steam generator element is permitted to expand through each of the turbine elements and is collected and returned to the liquid state in the condenser element. From the condenser element, the condensate is conducted through a series of feed pumps and feedwater heaters before it is reintroduced into the steam generator to complete the closed system.

Although the elements described above are found in virtually all of the steam power plants utilized for the generation of electrical power, it is well known to those skilled in the art that numerous other associated apparatus, such as boiler feed pumps or fans, are interconnected with the basic system above described.

It is also well known to those skilled in the art that steam power plants for the generation of electrical power commonly utilize steam driven turbines to provide a source of power for the associated apparatus. Most commonly, the steam supply source for the drive turbine is taken either from the high pressure turbine exhaust or from the exhaust of the intermediate pressure turbine element. However, a source of steam to supply a drive turbine element may be found at a predetermined extraction point within the low pressure turbine element.

The drive turbine for the associated apparatus is generally designed for maximum efficiency when the overall power plant is operating at its maximum calculated load. As the overall steam power plant load is reduced, for example, during those periods when peak power output is not required, the steam supply pressure to the drive turbine elements decreases in direct proportion to the decrease in the overall power plant load.

However, it is common to find that the power requirements of the associated apparatus do not decrease commensurately with the decrease in drive steam supply. Thus, the drive turbines are required to produce a proportionally greater power output in order to adequately power the associated apparatus at a time when the steam supply source to the drive turbines is decreasing. For example, at about 40% of the overall steam power plant maximum guaranteed load, the nozzle of the drive turbine for the associated plant apparatus is unable to pass sufficient steam flow in order to power the associated apparatus.

If the drive turbine has only a single steam chest, prior art has switched the drive turbine steam supply source to a higher pressure zone in order to meet the increased power requirements impressed upon the drive turbine by the associated plant apparatus. Such higher pressure zones utilized by the prior art for supplying the drive turbine elements include a cold reheater element of the overall system or the high pressure, high temperature throttle steam. If the drive turbine has a dual steam chest, the prior art admits high pressure steam from either of the chosen sources into the high pressure steam chest. In both cases however, the high pressure steam is throttled severely upon introduction into the drive turbine element, with a concomitant loss in available energy.

SUMMARY OF THE INVENTION

This invention discloses a steam turbine power plant having a pressure-increasing device disposed intermediate between a drive turbine steam supply source and a drive turbine element. The pressure-increasing device, commonly an ejector element, utilizes a predetermined amount of high pressure, high temperature steam as a motive fluid therein. The pressure-increasing device using the high pressure steam as a motive fluid, increases the pressure of the drive turbine supply steam so as to maintain a desired pressure level within the supply steam flow.

It is an object of this invention to provide a steam turbine power plant having a pressure-increasing device disposed between a drive turbine element and a drive turbine steam supply source. It is a further object of this invention to provide a pressure-increasing device which utilizes high pressure energy from within the overall power plant system to increase the pressure of steam drawn from a drive turbine steam supply source to maintain a desired pressure level within the drive turbine supply steam flow.

BRIEF DESCRIPTION OF THE DRAWINGS

The invention will be more fully understood from the following detailed description of an illustrative embodiment taken in connection with the accompanying drawings, in which.

DESCRIPTION OF THE PREFERRED EMBODIMENT

Figure 1:
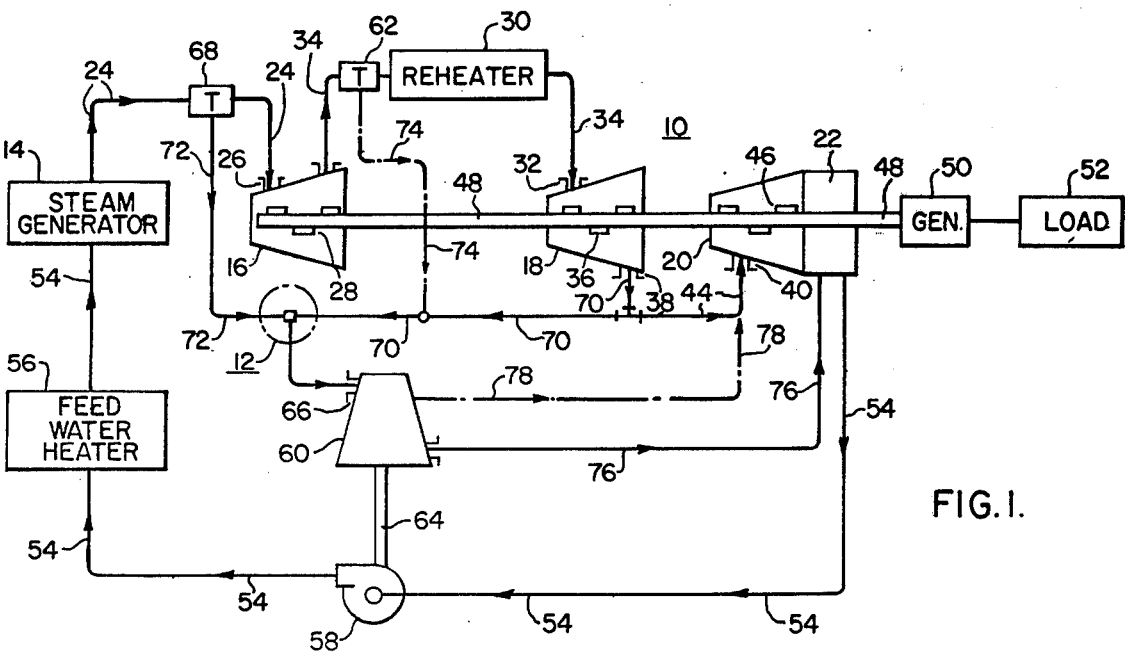
FIG. 1 is a diagrammatic view of a fossil fuel steam turbine power plant having a pressure-increasing device disposed in a location taught by this invention.

Throughout the following description similar reference characters refer to similar elements in all figures of the drawings.

Referring now to FIG. 1, a diagrammatic view of a fossil fuel steam turbine power plant 10 having a pressure-increasing device 12 therein is shown. The power plant 10 generally comprises a steam generator element 14, commonly a fossil-fueled boiler, which provides high pressure, high temperature motive fluid for the power plant 10. A high pressure turbine element 16, an intermediate pressure turbine element 18 and a low pressure turbine element 20 are connected in series with the steam generator 14. A condenser 22 collects and returns the motive fluid which has expanded through each of the turbine elements 16, 18 and 20 to the steam generator element 14 to complete the closed loop.

Steam flow leaves the steam generator element 14, and as illustrated by a reference arrow 24, is conducted into the inlet 26 of the high pressure turbine element 16. The steam flow expands through a plurality of alternating arrays 28 of stationary and rotating blades in the high pressure turbine element 16. After expanding through the high pressure turbine element 16, steam exhausts from the high pressure turbine element 16 and is conducted to a reheater element 30 and from there into the inlet 32 of the intermediate pressure turbine element 18, the flow being indicated by reference arrows 34.

Steam is permitted to expand through alternating arrays 36 of rotating and stationary blades within the intermediate pressure turbine element 18. The expanded steam is exhausted through the exhaust channel 38 of the intermediate pressure turbine element 18. The partially expanded steam may at this point be conducted through a second reheater element (not shown) if the system provides a double reheat capability and then into the inlet 40 of the low pressure turbine element 20. The more typical case, however, passes steam directly into the inlet 40 of the low pressure turbine element 20, as illustrated by reference arrows 44. Steam expands through alternating arrays 46 of rotating and stationary blades within the low pressure turbine element 20 and is collected and returned to the liquid state within the condenser element 22.

Steam which has expanded through the high pressure turbine element 16, the intermediate pressure turbine element 18, and the low pressure turbine element 20 converts the energy carried therein to mechanical rotational energy which is transmitted by a common shaft 48 to a generator element 50. The generator element 50 provides electrical energy to an associated electrical load 52.

The condensate collected by the condenser element 22 is reintroduced into the steam generator element 14 thus completing the closed-loop steam turbine power plant, as illustrated by reference arrows 54. It is common in the art to interpose between the condenser element 22 and the steam generator element 14 a series of feedwater heaters 56. The feedwater heater system has associated therewith a boiler feed pump 58. Although the drawing illustrates one feedwater heater 56 and one boiler feed pump 58, it is to be understood that any desired number of feedwater heaters and feed pumps may be interposed between the condenser element 22 and the steam generator element, 14.

The boiler feed pump 58 derives its source of power from a drive turbine element 60 disposed between a drive turbine steam source and the associated turbine apparatus. In the drawing, the steam supply source for the drive turbine element 60 is the intermediate pressure turbine exhaust 38. If the boiler feed pump turbine is a condensing type drive, as shown in FIG. 1, steam taken from the intermediate pressure turbine exhaust 38 is the most common source of steam supply for the drive turbine element 60. However, other sources of supply for the drive turbine element 60 are known in the prior art. For example, if a non-condensing drive is used for the boiler feed pump turbine 60, a common source of steam is found at the exhaust of the high pressure turbine 16, prior to the reheater 30. Such a steam source tap is illustrated by reference numeral 62.

A non-condensing drive is, of course, one which expands the motive steam from its inlet pressure condition down to an intermediate pressure level, lower than the inlet pressure, yet above the condenser pressure. On the other hand, a condensing drive turbine expands steam from its inlet pressure down to the condenser pressure.

Other associated turbine apparatus, in addition to the boiler feed pump 58, may be included in the fossil fuel steam turbine power plant 10. Although these other associated turbine apparatus, such as fans and blowers, are not shown for clarity, if such associated elements utilize a drive turbine element, similar to the drive turbine element 60, to provide a source of power therefor, it is to be understood that they are within the contemplation of this invention.

Steam derived from the supply turbine steam supply source expands through the drive turbine element 60 and provides the power required to drive the associated turbine apparatus connected to the drive turbine element. In this case, the associated turbine apparatus connected by a shaft 64 to the drive turbine element 60 is the boiler feed pump element 58.

It is standard practice in the prior art to have the drive turbine element 60 operate at maximum efficiency during the period of time when the overall power plant 10 is supplying the maximum calculated output to the electrical load 52. However, as the maximum calculated load on the overall power plant 10 is reduced, the steam supply pressure to the drive turbine element 60 decreases in direct proportion to the decrease in the maximum calculated load. Since the requirements of the associated turbine element, in this case the boiler feed pump element 58, does not decrease as rapidly as the pressure of the steam supplied to the drive turbine element 60, the drive turbine element 60 is required to supply a greater amount of power output to the boiler feed pump element 58 than can be produced when utilizing only steam provided from the drive turbine steam supply source, in this case, the intermediate turbine exhaust 38.

The prior art solves this problem in the case of a single steam chest drive turbine element by switching the steam source from the intermediate pressure turbine exhaust or the low pressure extraction point to a higher pressure zone within the power plant system. An example of such high pressure zone is the throttle of the high pressure turbine.

In the case of a drive turbine element having a dual steam chest, prior art solves the problem of low pressure steam supply by admitting high pressure steam from whatever source chosen into the high pressure steam chest on the drive turbine element concurrently with the admission of the lower pressure steam taken from the drive turbine steam supply source. In either case however, the high pressure steam is severely throttled upon introduction into the drive turbine element 60, thus dissipating available energy carried by the steam.

This invention provides a pressure-increasing device 12 disposed between the drive turbine steam supply, the intermediate turbine exhaust 38, and the inlet 66 to the drive turbine element 60. The pressure-increasing device 12, such as an ejector, utilizes a predetermined amount of high pressure, high temperature steam taken from a high pressure steam source, such as a tap on the throttle as illustrated by reference numeral 68, to serve as the motive fluid for the pressure-increasing device 12. This steam taken from the intermediate turbine exhaust 38 flows into the pressure-increasing device 12, the steam supply flow illustrated by reference arrows 70. At the same time, steam from the high pressure throttle tap 68 is also conducted into the pressure increasing device 12, this flow being illustrated by reference arrows 72. If the drive turbine 60 is a non-condensing type drive, as was mentioned earlier, the steam supply is drawn from the exhaust of the higher pressure turbine 16, immediately before the reheater 30, as illustrated by the tap 62. In this case, steam drawn from the tap 62 is conducted into the pressure increasing device 12, the flow indicated by the ghosted reference arrows 74.

The pressure-increasing device 12 increases the pressure of drive turbine supply steam drawn from the intermediate turbine exhaust 38 so that the drive turbine element 60 has sufficient steam pressure flow passing therethrough to meet the power requirements impressed on the drive turbine element 60 by the associated turbine apparatus, such as the boiler feed pump, during periods when the overall power plant 10 is operating below a predetermined portion of its maximum calculated load. Suitable control means (not shown) regulate the initiation of the pressure-increasing device 12.

To recapitulate, when the power plant 10 operates below a predetermined portion of maximum calculated load, such as at 40% load, drive turbine supply steam pressure drawn from the intermediate turbine exhaust 38 is not sufficient to meet the power requirements impressed upon the drive turbine element 60. At this time, the turbine control means (not shown) will initiate the pressure-increasing element 12 to provide the pressure-increasing response.

The pressure-increasing device 12 utilizes a portion of high pressure steam drawn from the throttle tap 68 as the motive fluid therein to increase the pressure of steam supplying the drive turbine 60. In the prior art, the high pressure steam was directly introduced into the drive turbine element which necessitated a severe throttling and concomitant loss in available pressure energy. A power plant system utilizing the teachings of this invention can increase its overall plant efficiency by utilizing only that predetermined portion of high pressure energy necessary to act as a motive fluid for the pressure-increasing device 12 and thus permitting the balance of the heretofore wasted high pressure energy to pass through the turbine elements 16, 18 and 20 within the power plant 10. It is apparent that the efficiency of the power plant 10 is increased over the efficiencies attainable by prior art power plants if an increased amount of high pressure, high temperature steam is permitted to flow through the power plant 10.

After the motive fluid has expanded through the drive turbine 60, it is exhausted into the condenser element 22, as illustrated by reference arrows 76. If, however, a non-condensing drive for the drive turbine 60 is utilized, steam drawn from the exhaust of high turbine 16 through the tap 62 is discharged from the drive turbine 60 and into the inlet 40 of the low pressure turbine 20, this flow being illustrated by reference arrows 78.

Figure 2:
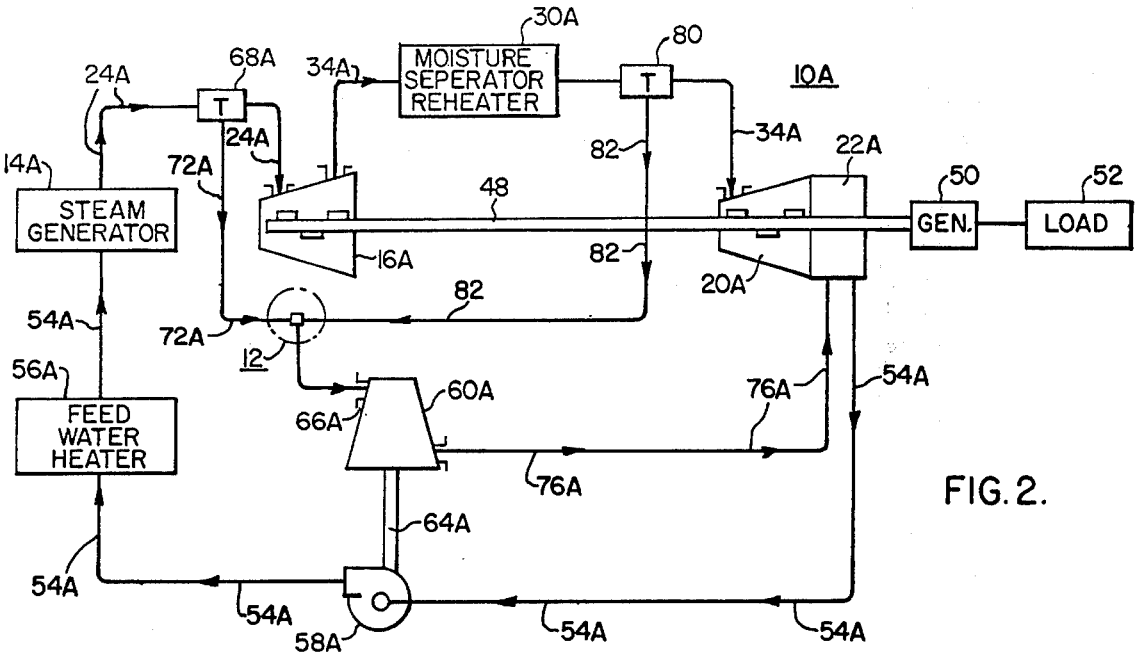
FIG. 2 is a diagrammatic view of a nuclear fuel steam turbine power plant having a pressure-increasing device disposed in a location taught by this invention; and, FIG. 3 is an elevational view, entirely in section, of a pressure-increasing device utilized by the teachings of this invention.

Referring to FIG. 2, if the power plant 10A were a nuclear power facility, some modifications to the system described in FIG. 1 would occur. The nuclear powered system 10A draws steam from a steam generator element 14A, commonly a nuclear steam generator, which is connected in series to a high pressure turbine element 16A, a low pressure turbine element 20A, and a condenser 22A. Disposed intermediate between the high pressure turbine element 16A and the low pressure turbine element 20A is a combined moisture separator-reheater element 30A. Intermediate the condenser 22A and the steam generator are at least one feedwater heater 56A and at least one boiler feed pump 58A. High temperature, dry and saturated steam flows from the steam generator element 14A, and, as illustrated by reference arrows 24A, enters the high pressure turbine element 16A. After expanding through the high pressure turbine element 16A, the steam exhausts into the moisture separator-reheater element 30A, and then into the low pressure turbine element 20A, the flow being illustrated by reference arrows 34A.

After expanding through the low pressure turbine 20A, the steam is returned to the liquid state in the condenser element 22A, and flows therefrom, as illustrated by reference arrows 54A, through the boiler feed pump 58A and the feedwater heater 56A into the steam generator 14A, to complete the closed loop.

As in the fossil fuel power plant shown in FIG. 1, the boiler feed pump 58A derives its power from a drive turbine 60A through a shaft 64A. In a nuclear steam power plant 10A, the drive turbine derives its steam supply from the discharge of the moisture separator-reheater element 30A, as illustrated by a steam tap 80.

Similar to the fossil fuel power plant shown in FIG. 1, it is standard practice to have the drive turbine element 60A operate at maximum efficiency during the period of time when the overall power plant 10A is supplying the maximum calculated output to the electrical load 52. However, as the maximum calculated load on the overall power plant 10A is reduced, the steam supply pressure to the drive turbine element 60A decreases in direct proportion to the decrease in the maximum calculated load. Since the requirements of the boiler feed pump 58A associated with the drive turbine 60A do not decrease as rapidly as the pressure of the steam being supplied to the drive turbine 60A from the discharge of the moisture separator reheater 30A, the drive turbine 60A must supply a greater amount of power to the boiler feed pump 58A than can be produced from the steam supplied from the tap 80.

The prior art in nuclear power generation attempted to solve this problem in a manner similar to that suggested by the fossil fuel art. Steam is supplied to the drive turbine from the throttle of the high pressure turbine 16A. This steam is severely throttled, however, and available energy dissipated in order to drive the drive turbine 60A during off-peak hours.

This invention teaches the disposition of the pressure-increasing element 12 between the drive turbine steam source tap 80 and the drive turbine 60A. Steam taken from the exhaust of the moisture separator-reheater element 30A, through the tap 80, is conducted as illustrated by reference arrows 82, into the pressure-increasing device 12. At the same time, and similar to FIG. 1, high pressure steam from a throttle tap 68A is conducted, as illustrated by reference arrows 72A, into the pressure-increasing device 12.

The pressure-increasing device 12 utilizes a portion of high pressure steam as a motive fluid from the tap 68A to increase the pressure of supply steam from the tap 80 to the drive turbine 60A. The steam flow from the pressure increasing device 12 enters the drive turbine inlet 66A. A nuclear power plant system utilizing the teachings of this invention can increase its overall plant efficiency by utilizing only that predetermined portion of high pressure energy necessary from the tap 68A to act as a motive fluid for the pressure-increasing device 12 and thus permitting the balance of the heretofore wasted high pressure energy to pass through the high pressure turbine element 16 and the low pressure turbine element 20A. It is seen that the efficiency of the power plant 10 is increased over the efficiencies attainable by prior art power plants if an increased amount of high pressure, high temperature steam is permitted to flow through the nuclear steam power plant 10A.

After expanding through the drive turbine 60A, the steam exhausts into the condenser 22A, as illustrated by reference arrows 76A.

Figure 3:
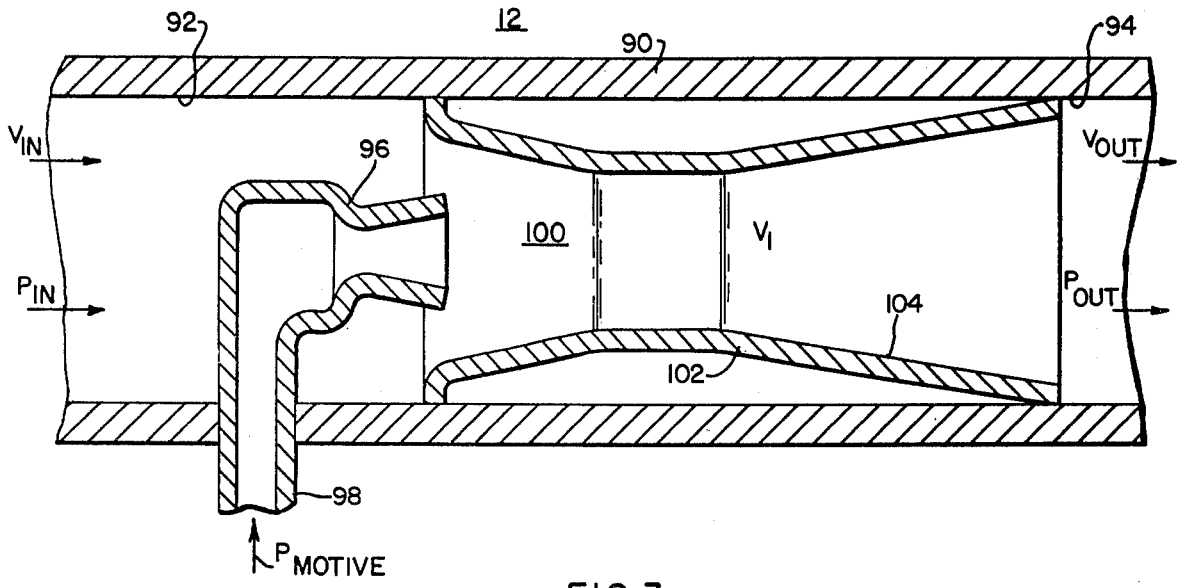

Referring now to FIG. 3, an elevational view of the pressure-increasing element 12, utilized in both the fossil fuel plant of FIG. 1, and the nuclear plant of FIG. 2 is shown. The pressure-increasing element 12 comprises an ejector element 90 having an inlet 92 and an outlet 94 therein. Although the pressure-increasing device 12 is an ejector it is to be understood that any device for raising the pressure levels of a fluid is within the contemplation of this invention. The inlet 92 of the ejector 90 is connected to the drive turbine steam supply source, either the intermediate turbine exhaust 38 in the fossil fuel plant (FIG. 1), or the exhaust of the moisture separator-reheater 30A in the nuclear plant of FIG. 2. The outlet 94 of the ejector 90 is connected to the inlets, 66 and 66A, of the drive turbine elements, 60 and 60A, respectively, as shown in FIGS. 1 and 2.

The ejector 90 has disposed therein a supersonic nozzle element 96. The supersonic nozzle element 96 is connected through an inlet 98 to a high pressure steam turbine source, such as the throttle tap connections shown at reference numeral 68 in FIG. 1 and at reference numeral 68A in FIG. 2.

A predetermined amount of high pressure steam taken from the throttle tap 68 or 68A is utilized as the motive fluid for the pressure-increasing device 12.

Steam entering the ejector 90 from the drive turbine steam supply source has an inlet pressure indicated in FIG. 3 by $P_{IN}$ and a velocity indicated by $V_{IN}$. Steam entering the inlet 98 to the supersonic nozzle 96 has a pressure, $P_{MOTIVE}$, much higher than the pressure $P_{IN}$.

The highly pressurized ejector motive fluid passes through the supersonic nozzle 96 and is introduced into a mixing volume 100 defined by a mixing tube 102 disposed within the ejector 90.

Steam introduced into the mixing volume 100 after passing through the supersonic nozzle 96 has undergone a conversion of its high inlet pressure $P_{MOTIVE}$ to a lower pressure and an increased velocity due to the nature of the supersonic nozzle 96. The high velocity motive fluid in the mixing volume 100 intermingles and increases the velocity of the supply steam which passes through the mixing volume 100 within the ejector 90. The result of intermixing the high velocity motive fluid with the lower velocity drive turbine steam in the mixing volume 100 is to provide the drive turbine supply steam with a velocity $V_1$ that is greater than the velocity $V_{IN}$.

The drive turbine supply steam moving at a velocity $V_1$ is then passed through a diffuser element 104 located within the ejector 90 adjacent the outlet 94 thereof. The diffuser 104 transforms the drive turbine steam supply having a velocity $V_1$ so that the drive turbine steam supply exits the ejector element 90 having a velocity $V_{out}$ and a pressure $P_{out}$. The net result of passing the drive turbine steam supply through the ejector element 90 is to increase the pressure of the drive turbine supply steam from $P_{in}$ to the value $P_{out}$. By properly designing the size of the nozzle 96, the mixing volume 100, and the diffuser 104, the pressure $P_{out}$ at which the drive turbine supply steam exits the ejector 90 is the required pressure needed to supply the drive turbine element so that it can meet the power requirement impressed thereon by the boiler feed pump apparatus.

It is thus seen that either a fossil or nuclear power plant 10 utilizing a pressure-increasing device 12 according to the teachings of this invention can provide a steam supply with a predetermined pressure level to the drive turbine element. It is also seen that by utilization of the teachings of this invention only that portion of the high pressure steam utilized by the pressure-increasing device 12 is diverted from passing through the power plant, thus providing a greater efficiency for power plants utilizing the teachings of this invention.

I claim as my invention:

1. A steam turbine power plant for producing energy for a load, said power plant comprising:

an associated apparatus connected within said power plant;

a drive turbine element providing energy for said associated apparatus;

a low pressure steam supply source connected to said drive turbine; and, pressure-increasing means for increasing the pressure of said low pressure supply steam, said pressure-increasing means disposed between said low pressure steam supply source and said drive turbine.

2. The power plant of claim 1, wherein said pressure-increasing means is an ejector.

3. The power plant of claim 2, further comprising:

a high pressure steam source connected to a second turbine element within said power plant; and, control means for introducing a predetermined amount of high pressure steam from said high pressure steam source into said ejector to increase the pressure of said supply steam from said low pressure steam supply source to a predetermined level.

4. The power plant of claim 3, wherein said control means is adapted to introduce said high pressure steam into said ejector when said load drops below a predetermined value.

5. The steam turbine power plant of claim 1 further comprising:

a high pressure turbine element and a low pressure turbine element connected on a common shaft within said power plant, a steam conduit connecting said high pressure turbine element to said low pressure turbine element, a source of high pressure steam connected to said high pressure turbine element for supplying high pressure steam thereto, said steam from said high pressure steam source expanding through said high pressure turbine and exhausting therefrom, said exhaust from said high pressure turbine element being conducted by said conduit into said low pressure turbine element, said steam conducted into said low pressure turbine element expanding therethrough and exhausting therefrom, and wherein, said low pressure steam supply source comprises said steam extracted from said low pressure turbine element.

6. A steam turbine power plant for producing energy for a load, said power plant comprising:

a high pressure turbine element and a low pressure turbine element connected on a common shaft within said power plant, a steam conduit connecting said high pressure turbine element to said low pressure turbine element, a source of high pressure steam connected to said high pressure turbine element for supplying high pressure steam thereto, said steam from said high pressure steam source expanding through said high pressure turbine and exhausting therefrom, said exhaust from said high pressure turbine element being conducted by said conduit into said low pressure turbine element, said steam conducted into said low pressure turbine element expanding therethrough and exhausting therefrom, an associated apparatus connected within said power plant, a drive turbine element providing energy for said associated apparatus, a low pressure steam supply source connected to said drive turbine, said low pressure steam supply source comprising steam extracted from said low pressure turbine element, and a pressure-increasing ejector element connected between said extraction of said low pressure turbine element and said drive turbine element, a predetermined portion of steam from said high pressure steam source being conducted to said ejector element as a motive fluid therefor to increase the pressure of said steam from said extraction of said low pressure turbine element to a predetermined level.

7. A steam turbine power plant for producing energy for a load, said power plant comprising;

a high pressure turbine element connected within said power plant, a steam conduit connected to said high pressure turbine element, a reheater element connected by said steam conduit to said high pressure turbine element, a source of high pressure steam connected to said high pressure turbine element for supplying high pressure steam thereto, said steam from said high pressure steam source expanding through said high pressure turbine and exhausting therefrom, said exhaust from said high pressure turbine element being conducted by said conduit into said reheater element, an associated apparatus connected within said power plant, a drive turbine element providing energy for said associated apparatus, a low pressure steam supply source connected to said drive turbine, said low pressure steam supply source comprising steam from a predetermined location within said reheater element, and, pressure-increasing means for increasing the pressure of said low pressure supply steam, said pressure-increasing means disposed between said low pressure steam supply source and said drive turbine.

8. The steam power plant of claim 7 wherein:

said pressure-increasing means comprises an ejector, said ejector being connected between said predetermined location of said reheater and said drive turbine element, and wherein, a predetermined portion of steam from said high pressure steam source is conducted to said ejector as a motive fluid therefor to increase the pressure of said steam from said reheater element to a predetermined level.

9. A nuclear steam power plant for producing energy for a load, said power plant comprising:

a high pressure turbine element and a low pressure turbine element connected on a common shaft within said nuclear power plant, a steam conduit connecting said high pressure turbine element to said low pressure turbine element, a combined moisture separator-reheater element disposed along said conduit between said high pressure turbine element and said low pressure turbine element, a nuclear steam generator providing high pressure steam to said high pressure turbine element, said steam from said nuclear steam generator expanding through said high pressure turbine element and exhausting therefrom, said exhaust from said high pressure turbine element being conducted by said conduit into said moisture separator-reheater element, an associated apparatus connected within said power plant, a drive turbine element providing energy for said associated apparatus, a low pressure steam supply source connected to said drive turbine, said low pressure steam supply sources comprising steam from a predetermined location within said moisture separator-reheater element, and, pressure-increasing means for increasing the pressure of said low pressure supply steam, said pressure-increasing means disposed between said low pressure steam supply source and said drive turbine.

10. The steam power plant of claim 9 wherein:

said pressure-increasing means comprises an ejector, said ejector being connected between said predetermined location in said moisture separator-reheater and said drive turbine element, and wherein, a predetermined portion of steam from said nuclear steam generator is conducted to said ejector as a motive fluid therefor to increase the pressure of said steam from said moisture separator-reheater element to a predetermined level.

* * * * *